United States Patent [19]

Yamazaki et al.

[11] Patent Number: 4,949,004

[45] Date of Patent: Aug. 14, 1990

[54] GAS DISCHARGE LAMP HAVING TEMPERATURE CONTROLLED, LIQUID RESERVOIR FOR LIQUIFIED PORTION OF GAS

[75] Inventors: Shunpei Yamazaki, Tokyo; Takashi Inujima; Kazuo Urata, both of Atsugi; Mamoru Tashiro, Tokyo; Yuji Tanamura, Machida; Shinji Imato, Atsugi; Kenji Itoh, Machida; Seiichi Odaka, Hisakata; Shigenori Hayashi; Naoki Hirose, both of Atsugi, all of Japan

[73] Assignee: Semiconductor Energy Laboratory Co., Ltd., Atsugi, Japan

[21] Appl. No.: 307,190

[22] Filed: Feb. 8, 1989

Related U.S. Application Data

[63] Continuation of Ser. No. 28,672, Mar. 20, 1987, abandoned.

[30] Foreign Application Priority Data

Mar. 24, 1986 [JP] Japan ..... 61-65515
Sep. 24, 1986 [JP] Japan ..... 61-226449

[51] Int. Cl.[5] ..... H01J 61/28; H01J 61/52

[52] U.S. Cl. ..... 313/35; 313/44; 313/45; 313/565; 313/634

[58] Field of Search ..... 313/35, 36, 44, 45, 313/565, 634

[56] References Cited

U.S. PATENT DOCUMENTS 3,983,385 9/1976 Troue ..... 313/35 X
4,295,074 10/1981 Ragland, Jr. ..... 313/565

*Primary Examiner*—Kenneth Wieder
*Attorney, Agent, or Firm*—Sixbey, Friedman, Leedom & Ferguson

[57] ABSTRACT

A mercury-vapor lamp is provided with a reservoir in which a superfluous amount of mercury is stored in the form of liquid state. The liquid mercury in the reservoir is cooled to a certain temperature. The pressure of mercury-vapor is automatically reduced to the saturated pressure of the liquid mercury cooled. In this configuration, the pressure of mercury-vapor is controlled by adjusting the temperature of the liquid mercury stored in the reservoir.

2 Claims, 5 Drawing Sheets

GAS DISCHARGE LAMP HAVING TEMPERATURE CONTROLLED, LIQUID RESERVOIR FOR LIQUIFIED PORTION OF GAS

This application is a Continuation of Ser. No. 07/028/672, filed Mar. 20, 1987, now abandoned.

BACKGROUND OF THE INVENTION

Field of the Invention

The present invention relates to a powerful source of ultraviolet rays and photochemical reactions that utilize the source of ultraviolet rays, and more particularly, an optical vapor phase reaction (vapor phase reaction that makes use of optical excitation) method that has a means of forming a covering film on, or of etching, a forming surface with large area, by the use of a high ontput source of ultraviolet rays.

Prior Art and Its Problems

As a thin film formation or etching technique by the use of vapor phase reactions, particularly well-known is the optical CVD method (method of chemically forming a thin film on a formation surface through decomposition of reactive gases by optical excitation) which activated reactive gases by means of optical energies. Compared with the existing method of thermal CVD or plasma CVD, this method is advantageous in that it enables to have film formation at low temperatures as well as it does not damage the formed surface.

However, the optical CVD method was possible neither to from a film with sufficiently large thickness beyond a certain value nor to form a film at a large enough speed of film growth, due to formation of a film on the surface of a window that is provided between an ultraviolet source and a reaction chamber. In the case of film of silicon nitride, the limiting thickness of the film is 1,000Å. In practice, however, if the limit could be raised to at least 2,000Å, then the method will become industrially applicable for the formation not only of passivation film but also of reflection preventive films and gate insulating films. For this reason, some method which permits to achieve such a goal has been sought earnestly.

On the other hand, while the intensity of light from a mercury lamp depends on the pressure of mercury, the pressure is automatically fixed by the satuated vapor pressure of mercury because the amount of mercury contained in the tube for lamp is choson superfluously in order to compensate for loss in the tube.

SUMMARY OF THE INVENTION

In order to resolve these problems, the present invention aims at increasing the intensity, on a surface to be irradiated, of a source of ultraviolet rays for photochemical reactions in the optical CVD method or optical etching method. For that purpose, electrodes are discharge which is generated in a low pressure mercury lamp are forcibly cooled at their lead-in terminals and a synthetic quartz glass tube that surrounds the electrodes, to prevent consumption of electrode material, especially of the material of the electrodes that are on the side which is hit by discharge ions, as well as to realize a supply of a current which is greater than in the prior art, in order to increase the emission intensity of a radiation of wavelength 185 nm to a value which is more than twice that of the prior art. Namely it is aimed at increasing the intensity of radiations that are emitted in transitions of mercury atoms from states that are excited by the receipt of electric energies of arc discharge within a low pressure mercury lamp, to a ground state (radiations of 185 nm and 254 nm that are generated in the transitions $6^1P_1$-$6^1S°$ and $6^3P_1$-$6^1S°$), and further, at increasing the intensity of ultraviolet rays on the surface to be irradiated. In this way, the present invention promotes the formation of a covering film on a formation surface through excitation or activation of reactive gases in a reaction chamber by ultraviolet rays, with especially preperably those of wavelength of 3 mm.

To achieve above object, the present invention increases the intensity of a source of ultraviolet rays, and at the same time, sets the distance between the upper end portion of a transparent covering plate and a formation surface at a value of 3 cm or less, preferably from 3 mm to 2 cm.

Since it is possible in the present to transport a large quantity of short wavelength ultraviolet rays of 185 nm to a forming surface of a substrate even without coating a window with oil or the like, it was possible to improve the limiting thickness of a formed film from the prior value of 1,000Å (in the case of silicon nitride). In this way, it is possible to obtain, by the optical CVD alone, a sufficent film thickness which is required by a reflection preventive film of compound semiconductor such as InP, a gate insulating film of thin film type silicon semiconductor element, and a possivation film of compound semiconductor such as GaAs.

Further, the method of the present invention forms an oilfree reaction system which makes absolutely no use of Fomblim (a trademark of oil) or the like on the window, so that the degree of vacuum of the background level can be increased to less than $10^{-7}$ Torr. Moreover, the present invention permits to form optical CVD films due to optical excitation, of semiconductor films such as silicon, insulating films such as silicon oxide, silicon nitride, aluminum nitride, phosphorus glass, and boron glass, and conductor films of the metals such as aluminum, titanium, and tungsten or of silicides of these metals.

DETAILED DESCRIPTION OF THE PREFERRED EMBODIMENTS

Making reference to an embodiment shown in FIG. 1, details of the present invention will be described in what follows.

Figure 1:
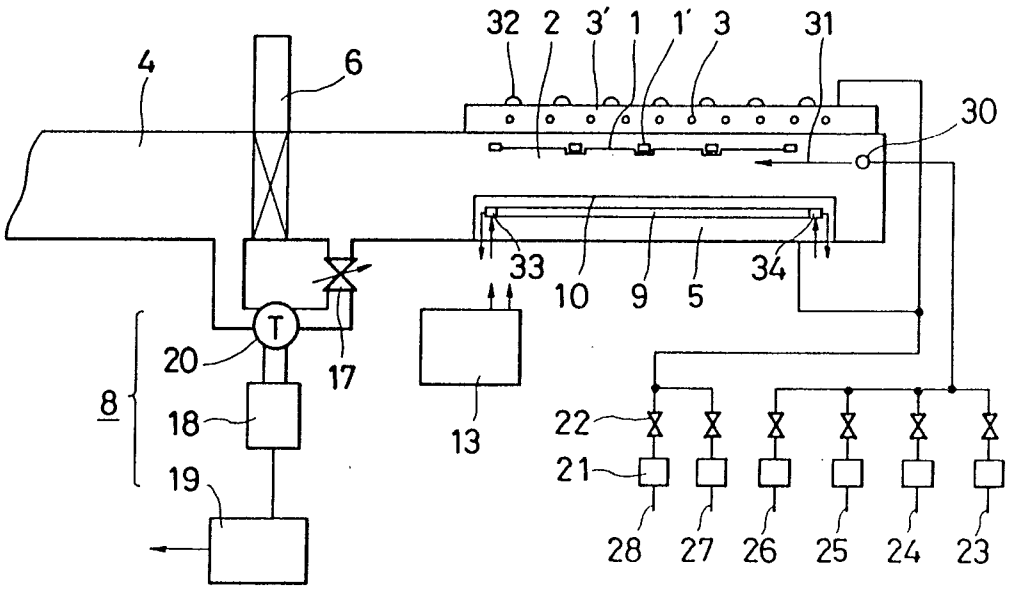
FIG. 1 is a diagram which illustrates the optical CVD of the present invention.

In FIG. 1, substrates (1) which have formation surfaces are held by a holder (1') and are placed in a reaction chamber (2). In the proximity of and above the substrate, there is provided a halogen heater (3) (with its upper surface cooled with a water curculation (32))

which has a heating chamber (3'). Below the reaction chamber (2) there is provided a light source chamber (5) which has a large number of ultraviolet ray sources (9) that consist of low pressure mercury lamps of forced cooling type which receive electric energies from a power supply (13). The light source chamber (5) and the heating chamber (3') are held at approximately equal degree of vacuum, each having a pressure difference of less than 10 Torr between the reaction chamber (2). For that purpose, a nonproduct gas (nitrogen, hydrogen, heluim, or argon) is supplied from (27) or (28) to the light source chamber (5) and the heating chamber (3') through a flow meter (21) and a valve (22).

Figure 2:
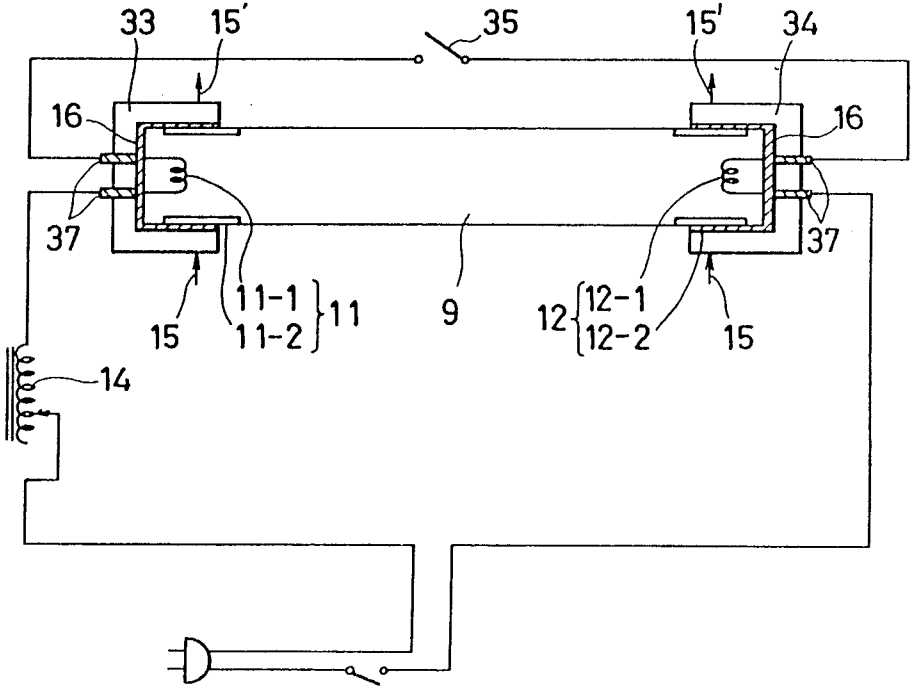
FIG. 2 is a diagram which illustrates the principle of the source of ultraviolet rays which consists of mercury lamps of forced cooling type of the present invention.

In FIG. 2 is shown the low presure arc discharge mercury lamp of forced cooling type which serves as a source of ultraviolet rays of the present invention used in the vapor phase reaction apparatus in FIG. 1.

The low pressure arc discharge mercury lamp (9) of the present invention shown in FIG. 2 has a pair of electrodes (11) and (12). Argon gas and mercury are sealed inside of a tube made of synthetic quartz which is held at a reduced pressure state.

Further, there is a choke coil (14) for impressing a voltage which is sufficient as an initial starting voltage, by shifting the phase by a small amount. First, a switch (35) is turned on to heat sufficiently the cathodes (11-1) and (12-1) on order to facilitate the emission of thermal electrons.

Then, the switch (35) is turned off, and an arc discharge is caused to take place by a high voltage which is generated then between the ends of the choke coil.

Namely, a discharge is started by a current which flows from the cathodes (11-1) and (12-1) to the anodes (11-2) and (12-2).

Further, the inductance of the choke coil is reduced. Then, the current that flows in the pair of electrodes (11) and (12) can be made large since the arc discharge has a negative resistance. As a result since the fact that the heat generated in the electrodes grows in proportion to the square of the current that is flowing, the lead-in terminals (37) are cooled by introducing a cooling medium in (33) and (34) from (15) and draining it from (15'), in order to cool the electrodes (11) and (12). Generally, water is used as a cooling meduim. However, flon or the like may be used as an example of other cooling medium.

In general, for electron emission, the electrodes (11-1) and (12-1) need be coated with a material such a s BaO which has a small work function. However, such a material with low work function has a weak anti-shock property, and the material is easily destructed by the collission of stoms such as argon and mercury.

Because of this, electrodes (11-2) and (12-2) that are not coated with BaO are used as electrodes with anti-shock property. In the present invention, the electrodes (11-2) and (12-2) are placed in the ring form close to or adjacent to the inner wall of the tube. The electrodes are forcibly cooled from outside of the tube, then, rise in temperature of the electrodes (11-2) and (12-2) can be prevented so that it becomes possible to flow a current which is about twice as large that in the prior art. As a result, in spite of a large current that is flowed it is possible to obtain a lamp life of at least close to 2,500 hours, with a range of decrease in the output which is less than 10% compared with the initial output.

Further, in order to sufficiently improve the heat conductivity between the forced cooling means (33), (34) and the current lead-in terminals (35) and the outer wall of the tube of the proximity of the electrodes, there is sealed a heat conductive paste (16).

With the above arrangement, it is possible to hold a maximun pressure by keeping the temperature rise within the tube at a value of 40° C., for example, of the design specifications. When in the vapor phase apparatus of FIG. 1 the source of ultraviolet rays (9) itself is heated by the heat from the heater for the substrate, it is of course effective to provide water cooling tubes that are disposed linearly beneath the tube close to each other.

In the case of manufacturing semiconductors such as silicon as a reaction product by means of the apparatus shown in FIG. 1, use is made of silanes ($Si_nH_{2n+2}$, $n \geqq 2$) that are gases of silicides or silicon halides ($H_xSi_2F_{6-x}$(x=0–5), $H_xSi_2C_{6-x}$(x=0–5), $H_xSi_3F_{8-x}$(x=0–8), $H_xSi_3Cl_{8-x}$(x=0–8), and the like) as the product gases. In addition, use is made of hydrogen, nitrogen, argon, or helium as a carrier gas for the nonproduct gases.

In the case of manufacturing a nitride (silicon nitride, aluminum nitride, gallium nitride, indium nitride, antimony nitride, or the like) as a reaction product, use is made respectively of $Si_2H_6$, $Al(CH_3)_3$, $Ga(CH_3)_3$, $In(CH_3)_3$, $Sn(CH_3)4$, and $Sb(CH_3)_3$ as a reaction product, which is supplied from (23). In addition, as a nonproduct gas which participates in the reaction, use is made of ammonia or hydrazine which is supplied from (26). Further, a nonproduct gas (hydrogen or helium) which does not participate in the reaction is supplied from (24) and (28) as a carrier gas.

In the case of manufacturing an oxide (silicon oxide, phosphorus glass, boron glass, aluminum oxide, indium oxide, tin oxide, or their mixture) as a reaction product, use is made of an oxide ($N_2O$,$O_2$, NO, or $NO_2$) as a product gas which participates in the reaction that is supplied from (26). In this case, a silicide ($Si_2H_6$, $Si_2F_6$, or $Si_2Cl_6$), aluminum compound ($Al(CH_3)_3$) or $Al(C_2H_5)_3$), indium compound ($In(CH_3)_3$ or $In(C_2H_5)_3$), tin compound ($Sn(CH_3)_4$ or $Sn(C_2H_5)_4$) or antimony compound ($Sb(CH_3)_3$ or $Sb(C_2H_5)_3$), respectively, is made use of as a product gas which is supplied from (23). In addition, hydrogen or helium as a nonproduct gas which does not participate in the reaction is supplied from (24) as a carrier gas. Further, phosphine ($PH_3$) and diborane ($B_2H_6$) are supplied from (25).

In the case of manufacturing a conductor (aluminum, tungsten, molybdenum, tin, or silicide of each), use is made of hydrogen, argon, or helium as a nonproduct gas. In addition, $Al(CH_3)_3$, $WF_6$, $W(C_2H_5)_5$, $MoCl_5$, $Mo(CH_3)_5$, $TiCl_4$, $Ti(CH_3)_4$, or a mixture of each of these and $SiH_4$, $Si_2F_6$, $SiH_2Cl_2$, or $SiF_4$, is used respectively as a product gas, being supplied from (23) and (24). Further, hydrogen which is a nonproduct gas that does not participate in the reaction is supplied from (25) and (27) as a carrier gas.

Pressure control for the reaction chamber is accomplished by exhansting the gas through a turbo molecular pump (use is made of PG550 manufactured by Osaka Vacuum Co., Ltd.) (18) and a rotary pump (19) via a control valve (17) and a cock (20).

In pumping a reserve chamber (4) by an exhaust system (8), the reserve chamber (4) side of the exhaust system (8) is opened and the reaction chamber (2) side is closed by means of the cock (20). On the other hand, for pumping, or for causing photochemical reactions in, the reaction chamber, the reaction chamber side is opened and the reserve chamber side is closed.

In the process of film formation, there is adopted the load and lock system which will not give rise to a pressure difference during transportation of a substrate from the reserve chamber to the reaction chamber. First, the reserve chamber is pumped following insertion and disposition of a substrate (1) and a holder (1') in the reserve chamber. Then, the substrate (1) and the holder (1') are moved into the reaction chamber (2) which is pumped to a vacuum of $10^{-7}$ Torr or less by opening a gate valve (6) which is provided between the reserve and reaction chambers. The reaction chamber (2) and the reserve chamber (4) are partitioned again by closing the gate valve (6).

Following that, a nonproduct gas is introduced into the light source chamber and the heating chamber at a flow-rate of 100 to 1,500 cc/min, in order to prevent mixing of reactive gases in the light source chamber due to reverse flow. At the time, a nonproduct gas, for example, $NH_3$, which partipates in the reaction is supplied to the reaction chamber. The system is left standing in that state for abount 30 minutes to cause photoetching of a formed surface of the substrate by active hydrogen and fluorine that are generated in the photodecomposition of the gases. With this arrangement, etching by irradiation became possible as a result of removal of oxides from the formed surface, leaving the surface nice and clean. Following that, a product gas out of reactive gases is supplied to the reaction chamber through a nozzle (30).

As a light source for reaction, use is made of low pressure arc discharge mercury lamps (9) made of synthetic quartz tube, equipped with forced cooling means (33) and (34). Namely, the source of ultraviolet rays consists of a low pressure mercury lamp (capable of emitting radiations of wavelengths 185 nm and 254 nm, having an emission length of 40 cm, an irradiation invensity of 60 to 100 mW/cm$^2$, and a lamp power of 150 to 500 W), made of synthetic quartz.

Ultraviolet rays from the source irradiate reaction gases (31) and the forming surface (1') of the substrate (1) in the reaction space of the reaction chamber (2), through a transparent covering plate (10) made of synthetic quartz. The heater (3) is of "deposition up" type which is placed on the upper side of the reaction chamber (2). By so arranging, it is possible to avoid generation of a cause for creating pin holes through attachment of flakes on the forming surface, and the substrate (1) is heated from its rear side by the halogen heater at a predetermined temperature (in the range of the room temperature and 700° C. The reaction chamber is made of stainless steel. The source of ultraviolet rays is housed in a light source chamber which is held in a vacuum. The light source chamber and the reaction chamber are held under a reduced atmosphere, surrounded by a staunless steel container. Because of this, it is possible with no technical difficulty to form a film on a large substrate with a size of 30 cm×30 cm instead of a small area of film formation of 5 cm×5 cm.

A concrete example of the present invention will be described in the following experimental example.

Experimental example: An example of formation of silicon nitride films.

In FIG. 1, ammonia was supplied from (25) at a rate of 200 cc/min and disilane was supplied from (23) at a rate of 20 cc/min, as reactive gases. By setting the substrate temperature at 350° C., a result as shown by the curve (40) of FIG. 3 was obtained. The substrate used was 4 wafers with diameter of 5 inches. The pressure within the reaction chamber was 10.0 Torr.

As a nonproduct gas which does not patricipate in the reaction, nitrogen was introduced from (27) at a flow rate of 200 cc/min.

Figure 3:
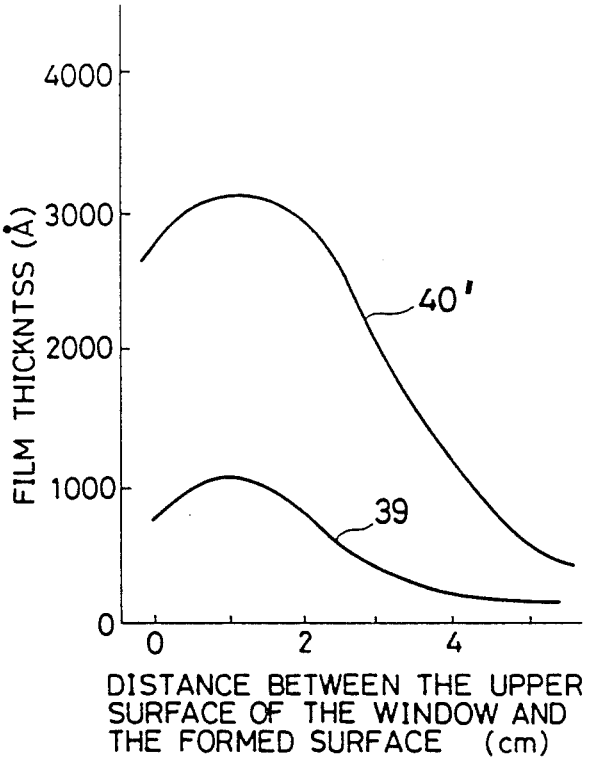
FIG. 3 is a diagram which showns the dependence of the thickness of silicon nitride films that are formed by the present invention on the distance between the window of the silicon nitride film and the formed surface.

With a reaction for 50 minutes, there were obtained silicon nitride films with thickness in the range of 1,000 to 3,500 Å were obtained. The intensity of ultraviolet rays (185 nm) on the forming surface was 40 mW/cm$^2$. The dependence of the thickness of the formed film on the distance between the covering plate and the substrate that has a formed surface is as shown in FIG. 3. It will be seen from FIG. 3 that a maximum thickness of 3,000Å was obtained for 1 cm of the distance between the upper surface of the window and the formed surface. It will be seen also that it is very important to have the distance to be less than 3 cm, preferably less than 2 cm, in order to obtain a film thickness which is greater than 2,000Å.

As may be seen from the figure, when use is made of the well-known conventional mercury lamps, instead of using mercury lamps of forced cooling type of the present invention, the intensity of ultraviolet rays cannot be raised beyond 20 mW/cm$^2$. Because of this, the maximum thickness in this case was up to 1,000Å (for the case of the distance of 1 cm to the substrate) which is shown by the curve (39) of FIG. 3.

Figure 4:
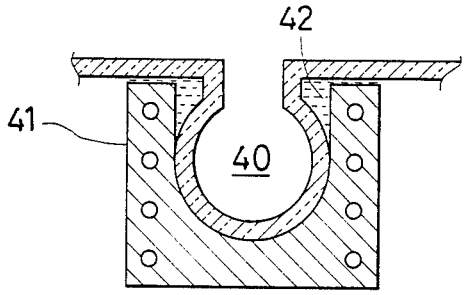
FIG. 4 is a partial section view showing another embodiment of the invention.

Referring now to FIG. 4, another embodiment of the invention will be described. while in the above explained embodiment the ends of the mercury lamp are cooled, this embodiment pertains to a source of ultraviolet rays having a cololing system of another type. As long as concerning the vapor pressure of mercury vapor in the light source chamber, advantages of the invention can be obtained only by cooling a mercury reservoir in which superfluous mercury is accumulated in vapor phase. FIG. 4 is a section view of the reservoir which is provided on and projected from the synthetic quartz tube of the light source at a position near the end of the tube where plasma does not arise. Around the reservoir 40 a cooling device 41 is provided with oil layer 42 inbetween which makes a thermal connection between the reservoir 40 and the cooling device 41. The cooling device is made from a substance having a high heat conductance such as aluminium, copper or so on, and provided with a plurality of water conduits therethrough. The temperature of the liquid mercury in the reservoir can be adjusted by regulating the flowing rate of cooling water circulating in the conduits with reference to the measured temperature of the mercury by a temperature sensor (not shown in the figure) provided on the reservoir.

Figure 5A:
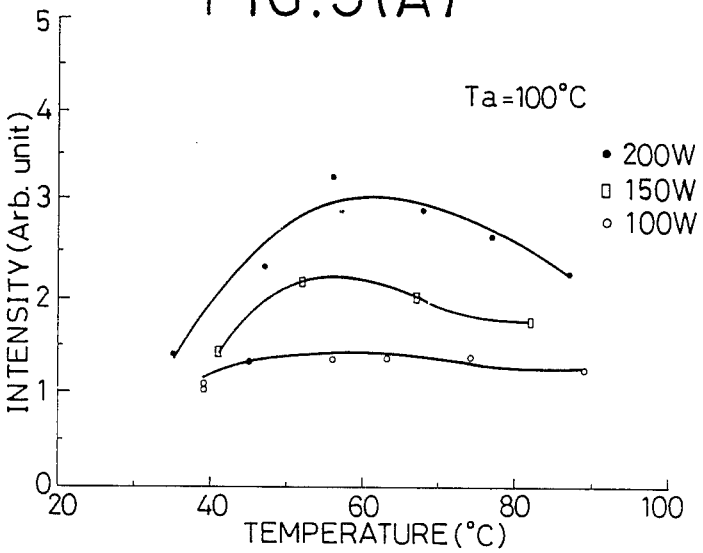
FIGS. 5(A) to 5(C) are graphical views showing the relation ship between the temperature of the stored mercury and the intensity of the ultraviolet rays.
Figure 5B:
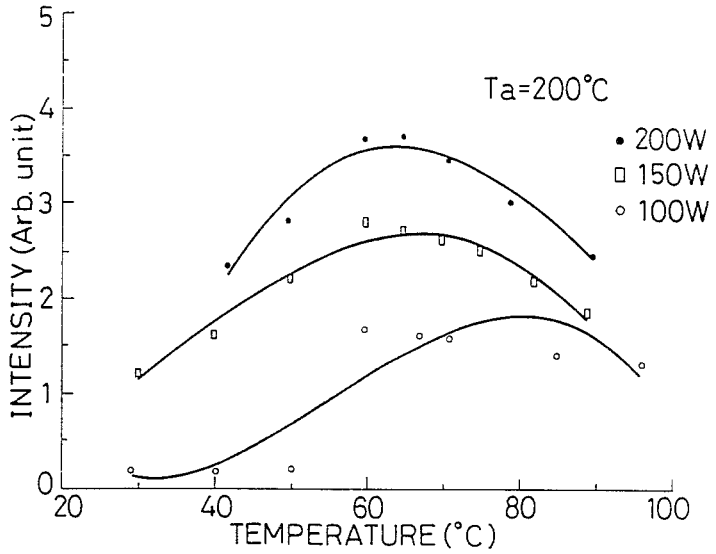
Figure 5C:
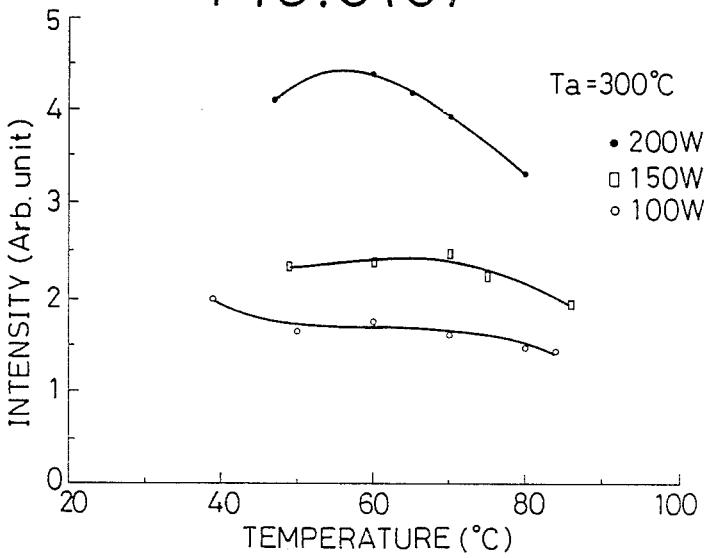

FIG. 5(A) to 5(C) show the relationships of the intensity of the light source of the another embodiment versus the temperature of liquid mercury in the mercury reservoir with power supplies of 200 W, 150 W and 100 W. "Ta" means temperature of atmospher, namely, the temperature of the tube of the light source. As shown in FIG. 5(A), the highest intensity can be obtained at about 60° C. in liquid mercury temperature when imput power is 200 W at the atmospheric temperature of 100° C. in temperature atmospher. When the temperature of atmospher is 200° C., the optimum temperatures are clearly seen from FIG. 5(B) for each power supply. The optimum temperatures, however, become unclear at 300° C. in atmospheric temperature as shown in FIG. 5(C). It should be understood that the figures are only examples and one desires to know the optimum temperature to which the mercury reservoir should be cooled, should examine for the case. With this configuration, the pressure of mercury in the tube is determined not by the atmospheric temperature but by the temperature of mercury in a reservoir which is controlled by the cooling device.

As may be clear from the foregoing description, the present invention succeeded in forming a film on a substrate of large area, by reducing consumption of electrodes of low pressure mercury lamps and by passing a large current in the lamp. As a result, it was possible to increase the limiting film thickness from the conventional valve of 1,000Å to a valve which is greater than 3,000Å as seen at 40' in FIG. 3. In addition, by applying a high frequency of 100 Hz to 1 kHz to the mercury lamps, and by adjusting its power factor, it was possible to increase the emission intensity of the radiation of 185 nm wavelength. Further, according to the present invention, it is possible to obtain a maximum film thickness by choosing the distance between the transparent covering plate and the film surface at a valve of 3 cm or less, preperably 0.3 to 2 cm. The present invention was possible to produce excellent silicon nitride films that possess interface level density of less than $3\times10^{11}cm^{-2}$.

In the foregoing the present invention was described in conjunction with the formation of silicon nitride films. However, various of semiconductors, insulators, conductors, and others such as amorphous silicon films, silicon oxide films, phosphorus glass which contains these substances along with added impurities, boron glass, or aluminum, can be formed by the use of the same technical ideas. In addition, it is effective to form passivation films on iron, nickel, cobalt, or magnetic substances of their compounds, by the use of carbonyl compounds of iron, nickel, or cobalt that has not been touched upon in the foregoing as a reactive gas.

It should also be mentioned that a dopant may also be added in the formation of silicon semiconductors in the experimental example.

In addition, if the environmental pollution could be disregarded, the speed of film growth may be improved by passing the reactive gases through a mercury bubbler.

In FIG. 1, the light source was placed in the lower part and the reaction space was provided in the upper part of the system. However, if the removal of flakes that are generated can be removed with reasonal ease, then the disposition of the substrate can be facilitated by providing the reaction space in the lower part, contrary to the present embodiment. In addition, the light source may be disposed on a side direction of the apparatus if so desired.

The present invention should not limited to the specific embodiments as explained above and it should be understood that many modifications and variations shall occur to those skilled in the art. For instance, the source of ultraviolet rays may be effectively applied to photoetching systems or other technical fields besides the applications for chemical vapor deposition.

What is claimed is:

1. An ultraviolet ray source comprising:

a vacuum tube;

an anode and a cathode provided in said vacuum tube to produce discharge between the anode and the cathode;

a vaporous active substance contained in said vacuum tube and capable of being excited and emitting ultraviolet rays by virtue of the discharge; and a vapor pressure structure adjacent said vacuum tube comprising a reservoir retaining some liquified portion of said vaporous active substance and a cooling means for adjusting the temperature of the liquified portion of said vaporous active substance at which the vapor pressure of the liquified portion of said vaporous active substance is optimum for the emission, said liquified portion of said vaporous substance being vaporized substantially only in accordance with the temperature of the liquified portion and the pressure of the vaporous active substance.

2. An ultraviolet ray source comprising:

a vacuum tube;

an anode and a cathode provided in said vacuum tube to produce discharge between the anode and the cathode;

a vaporous active substance contained in said vacuum tube and capable of being excited and emitting ultraviolet rays by virtue of the discharge; and a vapor pressure structure adjacent said vacuum tube comprising a reservoir retaining some liquified portion of said vaporous active substance and a cooling means for adjusting the temperature of the liquified portion of said vaporous active substance at which the vapor pressure of the liquified portion of said vaporous active substance is optimum for the emission, vaporization of the liquified portion of the vaporous substance occurring substantially only in response to the pressure of vaporous active substance being less than the vapor pressure corresponding to the temperature of the liquified portion.

* * * * *